US012606951B2

(12) United States Patent
Levine et al.

(10) Patent No.: US 12,606,951 B2
(45) Date of Patent: Apr. 21, 2026

(54) METHOD FOR PRODUCING A WATER-REPELLENT TEXTILE

(71) Applicant: University of Oregon, Eugene, OR (US)

(72) Inventors: Jordan D. Levine, Portland, OR (US); Alex Q. Rosen, Eugene, OR (US); Darren W. Johnson, Eugene, OR (US); Tawney A. Knecht, Eugene, OR (US)

(73) Assignee: UNIVERSITY OF OREGON, Eugene, OR (US)

( * ) Notice: Subject to any disclaimer, the term of this patent is extended or adjusted under 35 U.S.C. 154(b) by 480 days.

(21) Appl. No.: 17/749,055

(22) Filed: May 19, 2022

(65) Prior Publication Data

US 2022/0380972 A1 Dec. 1, 2022

Related U.S. Application Data

(60) Provisional application No. 63/190,571, filed on May 19, 2021.

(51) Int. Cl.
*D06M 11/45* (2006.01)
*D06M 23/00* (2006.01)

(52) U.S. Cl.
CPC ..... *D06M 11/45* (2013.01); *D06M 23/00* (2013.01); *D06M 2200/12* (2013.01)

(58) Field of Classification Search
CPC ..... D06M 11/45
See application file for complete search history.

(56) References Cited

U.S. PATENT DOCUMENTS

2012/0313055 A1* 12/2012 Yukinobu ..... C23C 18/1216 427/532
2019/0321894 A1* 10/2019 Opalka ..... B22F 1/0545

OTHER PUBLICATIONS

Cochran, Unique chemistries of metal-nitrate precursors to form metal-oxide thin films from solution: materials for electronic and energy applications, J. Mater. Chem. A, 2019, 7, p. 24124-24149 (Year: 2019).*
Kim, Flexible metal-oxide devices made by room-temperature photochemical activation of sol-gel films, Nature, 489, p. 128-132, 2012 (Year: 2012).*
Lee, Mechanisms for hydrophilic/hydrophobic wetting transitions on cellulose cotton fibers coated using Al2O3 atomic layer deposition, Journal of Vacuum Science and Technology A 30, 01A163, 2012, p. 1-7 (Year: 2012).*
Daunis, Solution-processed oxide thin film transistors on shape memory polymer enabled by photochemical self-patterning, Journal of Materials Reserch, 33, p. 24-54-2462, 2018 (Year: 2018).*
Buck, et al., Chemistry, properties and uses of commercial fluorinated surfactants, T.P. Knepper, F.T. Lange (Eds.), The Handbook of Environmental Chemistry: Polyfluorinated Chemicals and Transformation Products. 2012, Springer, London, 1-19.
Barry, et al., Perfluorooctanoic Acid (PFOA) Exposures and Incident Cancers among Adults Living near a Chemical Plant. Environ Health Perspect 2013, 121 (11-12), 1313-1318.
Farre, et al., Perfluorinated compounds in food. T.P. Knepper, F.T. Lange (Eds.), The Handbook of Environmental Chemistry: Polyfluorinated Chemicals and Transformation Products. 2012, 127-14.
Shiwanov, E. Chain reactions: a deep look into the DWR dilemma and the current options for product designers. Inside Outdoor Mag. 2015, 24-29.
Hill, et al., Substitution of PFAS Chemistry in Outdoor Apparel and the Impact on Repellency Performance. Chemosphere 2017, 181, 500-507.
Stanley, et al., Sediment Toxicity and Bioaccumulation of Nano and Micron-Sized Aluminum Oxide. Environ. Toxicol. Chem. 2010, 29 (2), 422-429.
Lee, et al., Mechanisms for Hydrophilic/Hydrophobic Wetting Transitions on Cellulose Cotton Fibers Coated Using Al2O3 Atomic Layer Deposition. J. Vac. Sci. Technol. .A 2012, 30 (1), 01A163.
Johnson, et al., A Brief Review of Atomic Layer Deposition: From Fundamentals to Applications. Materials Today 2014, 17 (5), 236-246.
Damayanti, N. P. Preparation of Superhydrophobic PET Fabric from Al2O3—SiO2 Hybrid: Geometrical Approach to Create High Contact Angle Surface from Low Contact Angle Materials. J. Sol-Gel Sci. Techn. 2010, 1 (56), 47-52.
Pan, et al., Preparation of Superhydrophobic and UV Blocking Cotton Fabric via Sol-Gel Method and Self-Assembly. Appl. Surf. Sci. 2012, 259, 110-117.
Fulton, et al., Minerals to Materials: Bulk Synthesis of Aqueous Aluminum Clusters and Their Use as Precursors for Metal Oxide Thin Films. Chem. Mater. 2017, 29 (18), 7760-7765.
Smith, et al., Solution Based Prompt Inorganic Condensation and Atomic Layer Deposition of Al2O3 Films: A Side-by-Side Comparison. J. Vac. Sci. Technol. A 2014, 32 (4), 041501.
Kim, et al., Flexible Metal-Oxide Devices Made by Room-Temperature Photochemical Activation of Sol-Gel Films. Nature 2012, 489 (7414), 128-132.
Jo, et al., Ultralow-Temperature Solution-Processed Aluminum Oxide Dielectrics via Local Structure Control of Nanoclusters. ACS Appl. Mater. Inter. 2017, 9 (40), 35114-35124.
Wang, et al., Synthesis of the Hydroxide Cluster [Al13(μ3-OH)6(μ2-OH)18(H2O)24] 15+ from an Aqueous Solution. Inorg. Chem. 2011, 50 (11), 4683-4685.
Park, et al., In-Depth Studies on Rapid Photochemical Activation of Various Sol-Gel Metal Oxide Films for Flexible Transparent Electronics. Adv. Funct. Mater. 2015, 25 (19), 2807-2815.

(Continued)

*Primary Examiner* — Tabatha L Penny
(74) *Attorney, Agent, or Firm* — Miller Nash LLP

(57) ABSTRACT

A water-repellent textile is produce by applying to a textile a solution of $Al_{13}$ nanoclusters or aluminum nitrate or hydrates of aluminum nitrate in a solvent to produce a wetted textile; and photo-annealing the wetted textile with ultraviolet light having a wavelength in the range of 180 nm to 260 nm to produce an $Al_2O_3$ coating on fibers of the textile. The textile may be, for example, cotton, polyester, wool, nylon, chiffon, nubuck, leather, burlap, silk, denim, or any combination thereof. Preferably, the solvent is a solubilizing organic solvent, pure water, or a miscible organic/water solvent mixture.

12 Claims, 7 Drawing Sheets

(56) References Cited

OTHER PUBLICATIONS

Cochran, et al., Unique Chemistries of Metal-Nitrate Precursors to Form Metal-Oxide Thin Films from Solution: Materials for Electronic and Energy Applications. J. Mater. Chem. A 2019, 7 (42), 24124-24149.
Norelli, et al., Influence of Composition and Processing Parameters on the Properties of Solution-Processed Aluminum Phosphate Oxide (AlPO) Thin Films. Solid State Sciences 2016, 55, 8-12.
Levine, Jordan. Fabrication, characterization, and industrial viability of sustainable thin films and coatings derived from aluminum based nanoclusters. PhD Dissertation, Univ. Oregon. Jun. 2021.

* cited by examiner

*Fig. 4A*
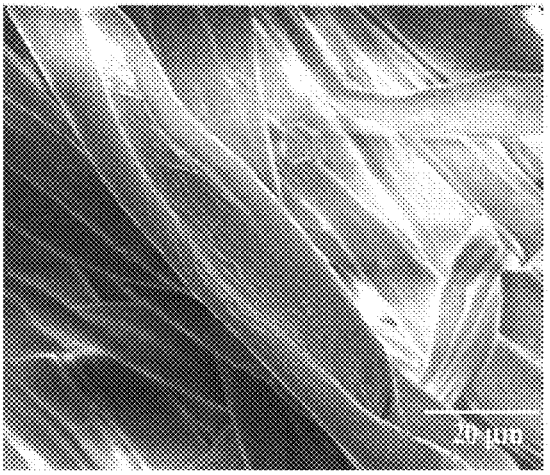
*Fig. 4B*
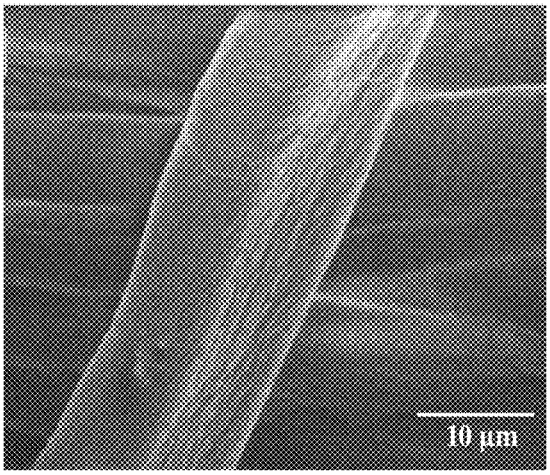
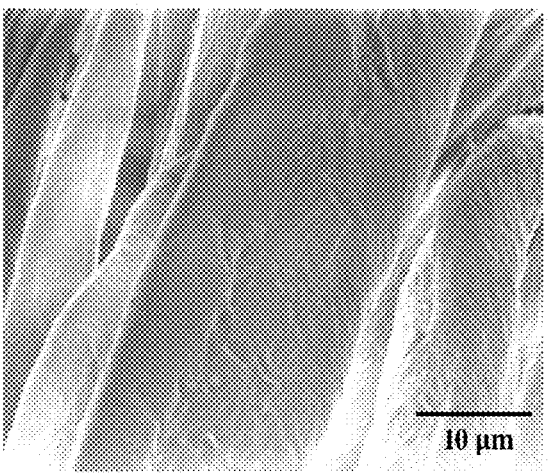
*Fig. 4C*
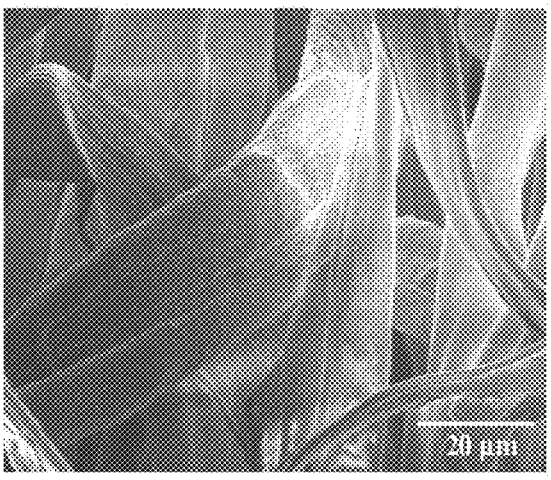
*Fig. 4D*

METHOD FOR PRODUCING A WATER-REPELLENT TEXTILE

CROSS-REFERENCE TO RELATED APPLICATIONS

This application claims priority from U.S. Provisional Patent Application 63/190,571 filed May 19, 2021, which is incorporated herein by reference.

FIELD OF THE INVENTION

The present invention relates generally to water-repellent textiles. More specifically, it relates to methods for treating a textile to produce a water-repellent textile.

BACKGROUND OF THE INVENTION

Traditional durable, water-repellent (DWR) coatings for textiles commonly use per- and poly-fluorinated chemicals (PFCs). These fluorochemicals are highly toxic and non-biodegradable. This has motivated the search for alternative DWR coatings for textiles, such as aluminum oxide.

There are currently two common methods for producing water-repellent aluminum oxide coatings on textiles. The first method includes using atomic layering deposition (ALD). This process works well for coating textiles with dense aluminum oxide and also demonstrates that aluminum oxide is an excellent hydrophobic coating on textiles. The ALD process, however, is extremely energy intensive, uses toxic precursors, and is not suitable for large-scale production since only about 1 square inch of fabric can be coated at a time. The second process uses a sol-gel method. This process involves multiple steps, the addition of organic additives, and is also not suitable for large-scale production due to the need for a microwave reactor to produce the precursor sol.

SUMMARY OF THE INVENTION

The present inventors have discovered a process for creating water-repellent textiles that uses inexpensive starting materials, can be solution processed via spray or dip coating, and is suitable for large-scale production. The method uses UV light and an aluminum precursor.

In one aspect, the invention provides a method for producing a water-repellent textile, the method comprising: applying to a textile a solution of $Al_{13}$ nanoclusters or aluminum nitrate or hydrates of aluminum nitrate in a solvent to produce a wetted textile; and photo-annealing the wetted textile with ultraviolet light having a wavelength in the range of 180 nm to 260 nm to produce an $Al_2O_3$ coating on fibers of the textile. The textile may be, for example, cotton, polyester, wool, nylon, chiffon, nubuck, leather, burlap, silk, denim, or any combination thereof. Preferably, the solvent is a solubilizing organic solvent, pure water, or a miscible organic/water solvent mixture.

In one implementation, the solvent is acetone/water, and the solution has an acetone/water ratio ranging from 1:1 to 10:1. More preferably, the solution has an acetone/water ratio of 5:1. In another implementation, the solution is a 5 mM to 20 mM solution of $Al_{13}$ nanoclusters in acetone/water, where the $Al_{13}$ nanoclusters are flat-$Al_{13}$ nanoscale clusters, $Al_{13}(\mu_3\text{-}OH)_6(\mu\text{-}OH)_{18}(H_2O)_{24}(NO_3)_{15}$. In another implementation, the solution is a 0.05 M to 0.2 M solution of aluminum nitrate ($Al(NO_3)_3$ $9H_2O$) in acetone/water.

In some implementations, the solvent is ethanol, and the solution has a concentration no more than 5 mM. In other implementations, the solvent is 2-methoxy ethanol, and the solution has a concentration ranging from 5 to 20 mM. In other implementations, the solvent is ethanol or ethanol/water, and the mixed solution has an ethanol/water ratio ranging from 1:1 to 10:1.

Applying the solution to the textile may include, for example, spray coating, drip coating, drop coating, dip coating, spin coating, or ink jet printing.

The ultraviolet light preferably has wavelengths with at least one peak below 190 nm and/or at least one peak above 200 nm. More preferably, the ultraviolet light has wavelengths with peaks at 253.7 and 183.9 nm.

In one implementation, photo-annealing the wetted textile with ultraviolet light is performed with a mercury lamp having power in the range 25-28 mW/cm$^2$, or more preferably in the range 5-8 mW/cm$^2$. Preferably, photo-annealing the wetted textile with ultraviolet light heats the wetted textile to a temperature no more than 150° C. The method may also include thermally treating the textile at a temperature no more than 150° C., or more preferably at a temperature no more than 60° C.

BRIEF DESCRIPTION OF THE DRAWINGS

FIGS. 4A-4D are SEM images of native cotton, and sample $Al_{13}$-UV, $Al(NO_3)_3$-UV, and $Al_{13}$-UV/thermal.

DETAILED DESCRIPTION OF THE INVENTION

Introduction

Figure 1:
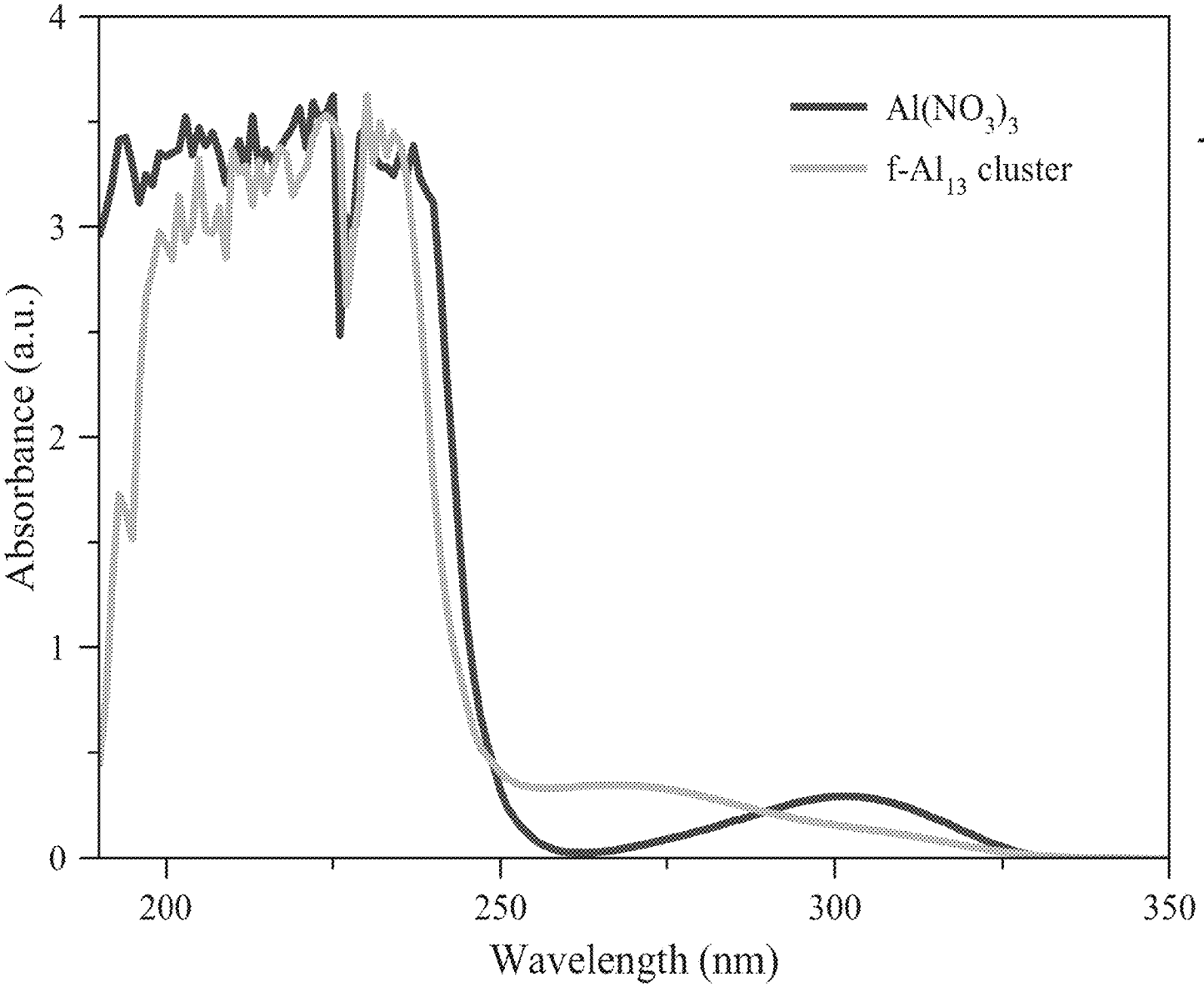
FIG. 1 is a graph of absorbance vs wavelength illustrating the UV absorbance spectra of $Al(NO_3)_3{\cdot}9H_2O$ and f-$Al_{13}$ cluster in nanopure $H_2O$.

The formation of hydrophobic coatings for textiles is of significant interest to a variety of industries, especially for the generation of waterproof apparel and footwear. The formation of these durable water repellents (DWR) has traditionally been fabricated using per- and polyfluoroalkyl substances (PFASs) due to their high level of water-repellent functionality and ease of deposition.[1] However, while these fluorinated coatings exhibit excellent hydrophobic performance, they are currently being phased out of a significant number of industrial processes.[2] This industry-in wide change is due to the increasing health and environmental concern that PFASs pose. These substances have not only shown extreme environmental persistence and bioaccumulation[3], but they are also associated with cancer, toxic effects on the immune system, and even increased mortality rates.[4-6]

Since these PFAS's have been identified as problematic, there has been a continuing challenge to replace fluorinebased durable water repellents and replace them with greener alternatives.[7] In addition to being environmentally benign, it is important that any proposed process requires minimal steps, can be processed at low temperatures, and can be easily scaled up for industrial implementation.

One interesting alternative being investigated as DWR on textiles is aluminum oxide ($Al_2O_3$). $Al_2O_3$ coatings are highly transparent, inexpensive to produce, exhibit strong hydrophobic properties, and are considerably less toxic than the currently used PFAS alternatives.[8] There have been many attempts to coat textiles with aluminum oxide, but none of them have provided a low energy, efficient, and easily scalable approach to forming a dense aluminum oxide coating containing little or no impurities. Lee et. al. has shown that $Al_2O_3$ coated cotton fibers exhibit extremely hydrophobic character; however, the coatings were formed using atomic layer deposition (ALD) under vacuum conditions, which is extremely energy intensive and only allows for small sample sizes suggesting this process would be very difficult to scale up.[9,10] In an attempt to provide a more scalable process, researchers have investigated a sol-gel based approach, in which textiles are soaked in an aluminum based sol and heated to form the alumina coated textiles.[11,12] While these approaches are more scalable than an ALD approach, there are significant drawbacks including the use of a microwave reactor, heating up to 160-170° C., and the requirement of organic additives and ligands including ethyl acetoacetate (EAcAc) and sodium stearate to produce the final hydrophobic textile coatings.

While these ALD and sol-gel methods demonstrate the viability of aluminum oxide coatings, they fail to demonstrate the scalability needed to present a simple deposition approach that industry could readily adapt.

The inventors have discovered a new approach to address this challenge: a solution deposition fabrication technique of forming dense $Al_2O_3$ coatings. In a separate field of endeavor, a similar process has been demonstrated on silicon substrates and has shown to produce $Al_2O_3$ coatings, with no organic additive, spun-cast from an aqueous solution of the "flat" f-$Al_{13}$ hydroxo-cluster $[Al_{13}(\mu\text{-}OH)_{24}(H_2O)_{24}](NO_3)_{15}$.[13,14] The down-side of this approach is that formation of the final oxide coating requires thermal annealing of up to 500° C., which would not be suitable for textiles that would decompose or auto-ignite at temperatures considerably lower. The inventors have realized, however, that this relatively high processing temperature can be circumvented by using deep ultraviolet (DUV) light (i.e., wavelengths $\lambda$ in the range 185-254 nm) to photo-anneal the $Al_2O_3$ coatings.[15] In a separate field of endeavor, Jo. et al. demonstrated the fabrication of DUV photo-annealed $Al_2O_3$ films on silicon substrates, spun-cast from 2-methoxy ethanol solutions of $Al(NO_3)_3$ and f-$Al_{13}$. The combination of the DUV irradiation of the nitrate counterions and radiant heat from the mercury lamp (up to 160° C.) to remove residual solvent produced dense $Al_2O_3$ coatings that showed excellent dielectric properties.[16]

Adapting the techniques above to textiles, the present inventors utilize a solution deposition and DUV photo-annealing approach to produce hydrophobic $Al_2O_3$ coatings on textiles. This offers an easily scalable and low-temperature approach for forming $Al_2O_3$ coated textiles that requires no organic additives, can be deposited from environmentally benign solvents, and post-processed using only ultraviolet light, none of which are damaging to the underlying textile substrates.

In one example, hydrophobic coatings on cotton fabrics were successfully prepared via solution deposition of the "flat" aluminum hydroxo-nanocluster (f-$Al_{13}$) and $Al(NO_3)_3 \cdot 9H_2O$ precursor solutions. The final coatings were photo-annealed using ultraviolet light at 30° C. to produce a hydrophobic $Al_2O_3$ coating. The resulting coatings exhibit excellent hydrophobicity and through additional thermal annealing, coatings deposited from the f-$Al_{13}$ cluster achieved a water contact angle of 140.2° C. Elemental and morphological characterization of the resulting coatings were analyzed via XPS, AFM, SEM and EDX. This example demonstrated that this process for waterproofing textiles is simple, requires minimal steps, uses environmentally benign solvents (water and acetone) and is easily scalable.

Example—Materials and Methods

Preparation of f-$Al_{13}$ and $Al(NO_3)_3 \cdot 9H_2O$ Precursor Solutions

The f-$Al_{13}$ cluster $[Al_{13}(\mu\text{-}OH)_{24}(H_2O)_{24}](NO_3)_{15}$ was prepared using a previously published method.[17] In this simple precipitation method, $Al(NO_3)_3 \cdot 9H_2O$ (Acros Organics) and zinc metal powder (Sigma-Aldrich) were dissolved in nanopure water ($\rho$=18.2 M$\Omega$ cm) and filtered. The cluster then precipitates out of the filtrate solution as an amorphous white solid that was filtered, washed with isopropyl alcohol, and collected.

Preparation of UV-Annealed Textile Coatings

A 10 mM precursor solution of the f-$Al_{13}$ cluster was made in an acetone/water mixture and filtered through a 0.45 micron filter. For comparative studies, analogous $Al(NO_3)_3 \cdot 9H_2O$ solutions were prepared containing the equivalent aluminum concentration (130 mM). The precursor solutions were then drop cast or spray cast onto 2×2 cm square pieces of native cotton fabric using a Master G233 Pro Set airbrush with $N_2$ flow.

Figure 7:
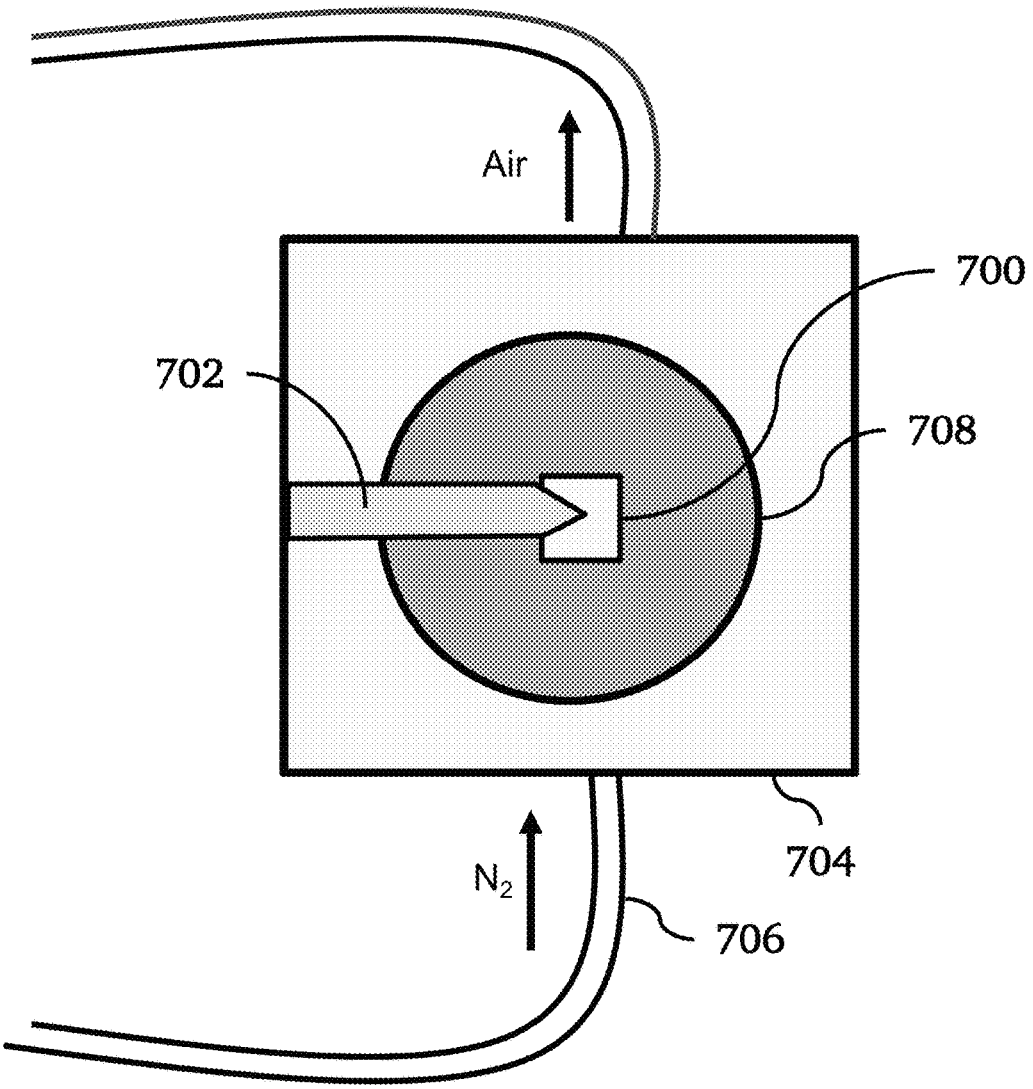
FIG. 7 is a schematic diagram illustrating an apparatus used to photo-anneal and heat a textile sample.

Referring to FIG. 7, once samples 700 were coated with precursor solution, they were photo-annealed using a Novascan PSD Pro Series digital UV ozone system equipped with a mercury grid lamp 702 emitting at 253.7 nm (90%) and 184.9 nm (10%). Samples were placed in the UV chamber 704, purged under $N_2$ atmosphere for 10 minutes via an inlet 706 and then subjected to 2 hours of UV treatment at ambient temperature. Radiant heat from the lamp 702 increased the sample temperature to 30° C. Samples that were thermally annealed were placed on a hot plate 708 and heated at 120° C. for 1 hour. The prepared samples are labeled based on the precursor used and the relative post treatment. For instance, a native cotton sample treated with the f-$Al_{13}$ cluster precursor solution and post annealed using UV light and thermal will be labeled as "$Al_{13}$-UV/Thermal".

Characterization

The UV-absorbance of the aluminum precursors were measured using an Agilent Technologies Cary 60 UV-Vis photospectrometer measuring from 190 nm-800 nm. Surface morphology images and composition were determined by scanning electron microscopy (SEM) and energy dispersive X-ray spectroscopy (SEM-EDS) using a ThermoFisher Helios Hydra Plasma FIB. To determine surface roughness of samples, atomic force microscopy (AFM) images were collected using a Bruker Dimension Icon atomic force microscope equipped with FastScan scanning 2 $\mu m^2$ areas of individual sample fibers. The wettability of the samples was determined by collecting images on a First Ten Angstroms FTA135 Contact Angle Analyzer. 10 $\mu$L of DI water was dropped onto the samples and images were collected on multiple spots of each sample. Images were processed using ImageJ contact angle plugin to determine water contact angle. Elemental composition of the prepared samples was investigated using X-ray photoelectron spectroscopy (XPS). Measurements were performed on a Thermo Scientific ESCALAB 250 spectrometer using a monochromated Al Kα X-ray source (150 W, 20 eV pass energy, 500 μm spot size). Peak fitting was done using ThermoScientific Avantage 4.75 software. A smart background subtraction was used for analysis and spectra were referenced to the C 1s hydrocarbon peak at 284.8 eV. Elemental ratios reported in this manuscript are the average of multiple spots measured across the same sample.

Results and Discussion

Preparation of Hydrophobic Coating and Effect of UV Photo-Annealing

In this example, aluminum oxide coated cotton fabrics were fabricated via the solution deposition technique from f-$Al_{13}$ cluster and compared to $Al(NO_3)_3$ precursor solutions. These coatings were photo-annealed with ultraviolet light to form the final hydrophobic $Al_2O_3$ coating.

In order for the solution processed aluminum precursors to form $Al_2O_3$, external energy is used to evaporate any residual solvent, decompose the nitrate counterions, and form Al—O—Al bonds. This is traditionally done through thermal post-processing at temperatures up to 500° C. However, by leveraging the susceptibility of nitrate counterions to decompose under deep ultraviolet light, the need for external thermal energy can be circumvented and a low temperature approach can be achieved. By irradiating the coated fabrics with UV light at 253.7 and 183.9 nm, nitrate photolysis occurs (eq. 1), producing an oxygen radical that reacts with water to form hydroxyl species (eq. 2), initiating the condensation of the final oxide.[18,19]

$$NO_3^- \xrightarrow{h\nu} {}^{\cdot}NO_2 + O^{\cdot -} \quad (1)$$

$$O^{\cdot -} + H_2O \leftrightharpoons O\cdot H + OH^- \quad (2)$$

FIG. 1 shows the UV absorbance spectra of $Al(NO_3)_3 \cdot 9H_2O$ and f-$Al_{13}$ cluster in nanopure $H_2O$. Since both the f-$Al_{13}$ cluster and $Al(NO_3)_3 \cdot 9H_2O$ absorb in the DUV range, the photo-annealing process can be leveraged to produce $Al_2O_3$ coatings. However, as demonstrated by Kim et. al., additional thermal energy is required to form the final oxide as UV alone is not sufficient to remove all residual solvent and counterions.[14,15] Coincidentally, Jo et. al. demonstrated the use of a high powered mercury lamp (25-28 mW $cm^{-2}$) can generate radiant heat from the lamp up to 160° C. and form dense $Al_2O_3$ without the need for any further thermal annealing after exposure to UV, allowing for a one-step annealing process.

It is important to note that for this particular example, coatings were annealed with a lower powered mercury lamp (7-8 mW $cm^{-2}$) that could only generate radiant temperatures up to 30° C. To compensate for this, additional thermal energy (hotplate=120° C.) was utilized to further reduce the nitrogen content, densify the coatings, and produce higher water contact angles. A higher power mercury lamp that generates substantial heat, however, would avoid this step. Therefore, when scaling up this process, a higher powered lamp would alleviate the need for extra external heating, eliminating the need to use external thermal energy.

Wettability of Coated Cotton Fabrics

In order to assess the wettability of the prepared coatings, the water contact angle (WCA) of treated and untreated samples was collected and shown in Table 1.

TABLE 1

Water contact angle measurements of native and $Al_2O_3$ coated cotton samples

| Sample | WCA (° C.) |
|---|---|
| Native Cotton | <10 |
| $Al_{13}$ - UV | 122.3 |
| $Al(NO_3)_3$ - UV | 118.1 |
| $Al_{13}$ - UV/Thermal | 140.2 |
| $Al(NO_3)_3$ - UV/Thermal | 127.2 |

Figure 2C:
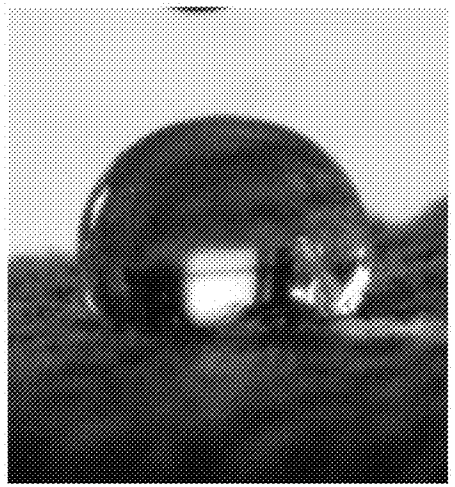
FIGS. 2A-2E are images illustrating water contact angles of untreated native cotton and samples treated with $Al_{13}$-UV, $Al(NO_3)_3$-UV, $Al_{13}$-UV/Thermal, and $Al(NO_3)_3$-UV/Thermal.
Figure 2B:
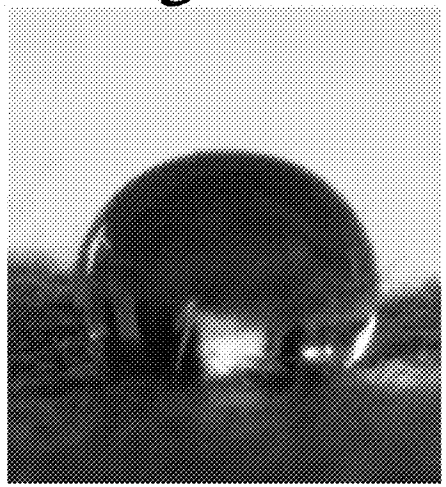
Figure 2E:
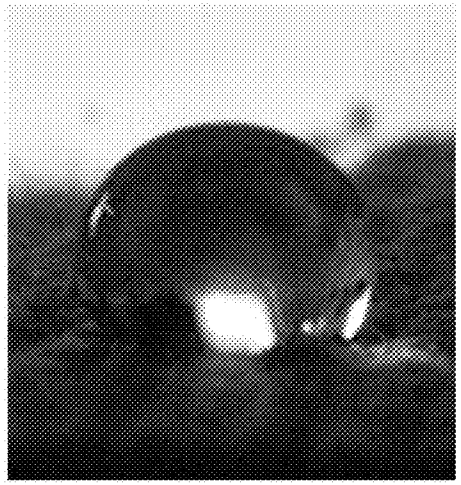
Figure 2D:
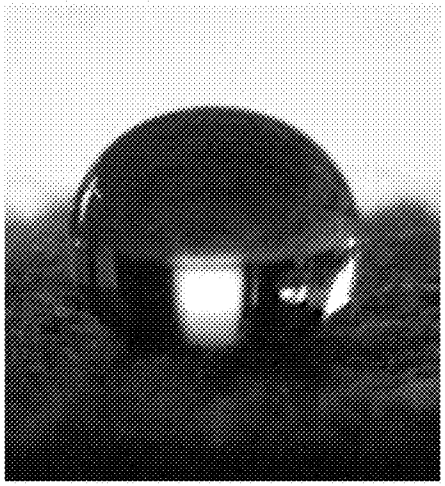
Figure 2A:
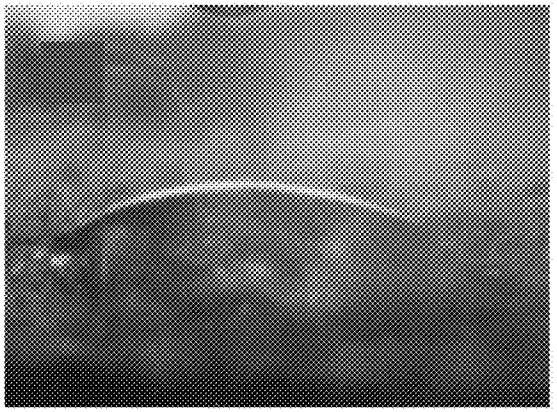

FIGS. 2A-2E show the images of samples with a 10 μL DI water droplet. Specifically, FIG. 2A shows a droplet on untreated native cotton. FIG. 2B shows a cotton sample treated with $Al_{13}$-UV, FIG. 2C shows a cotton sample treated with $Al(NO_3)_3$-UV, FIG. 2D shows a cotton sample treated with $Al_{13}$-UV/Thermal, and FIG. 2E shows a cotton sample treated with $Al(NO_3)_3$-UV/Thermal. The untreated native cotton samples (FIG. 2A) immediately absorb water making it difficult to determine the contact angle. However, after coating the cotton with the precursor solutions, and photo-annealing, the hydrophobicity is greatly increased. The contact angle results demonstrate that both $Al(NO_3)_3$ and $Al_{13}$ produce water repellent films with the f-$Al_{13}$ cluster outperforming the $Al(NO_3)_3$. This is likely due to the precondensed aluminum-oxygen network in the f-$Al_{13}$ cluster that more readily densifies to form the final oxide layer under these mild annealing conditions. These results show that hydrophobic coatings can be produced through photo-annealing of these aluminum precursors with no need for external thermal energy. With the radiant heat generated from the UV lamp increasing processing temperatures to only 30° C., this is one of the lowest processing temperatures we have discovered for generating hydrophobic coatings on textiles (WCA ~120° C.). However, adding thermal processing temperatures of 120° C. to the treated textiles does result in an increased WCA of 140.2° C. This increase in the contact angle can be attributed to the further evaporation of any remaining liquid solvent and removal of residual nitrate groups. Since any scale up of this process would likely use a higher powered lamp, it is likely that denser $Al_2O_3$ coatings would be produced, leading to these even higher water contact angles.

Morphology of Coated Cotton

Figures 3A, 3B, 3C:
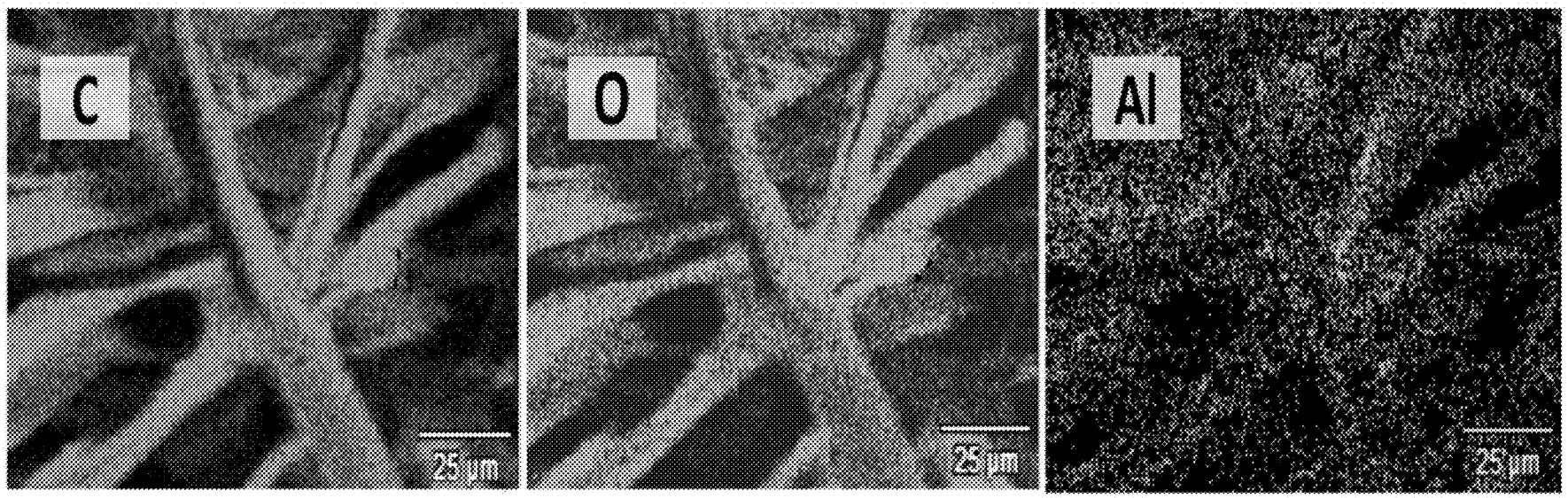
FIGS. 3A-3C are images illustrating EDX elemental mapping of carbon, aluminum, and oxygen on f-$Al_{13}$ sample UV and photo-annealed.

To ensure that $Al_2O_3$ was present on the surface of the textiles, elemental mapping via SEM-EDX was carried out. FIGS. 3A-3C show an example of the elemental mapping of carbon, oxygen, and aluminum for an f-$Al_{13}$ sample that was UV and thermally annealed. Specifically, FIG. 3A shows EDX elemental mapping of carbon, FIG. 3A shows EDX elemental mapping of aluminum, and FIG. 3A shows EDX elemental mapping of oxygen. The location of the aluminum on the fibers overlapped with oxygen, strongly indicates the presence of alumina on the surface.

One unique aspect of the solution deposition process is the ability to uniformly coat the substrates using a variety of solution deposition techniques such as spray coating, drip coating, drop coating, or spin coating. These methods allow for relatively low concentrated solutions to be deposited and fully immerse the substrate in the precursor solution with little to no waste. Additionally, the precursor solution concentration can be optimized to control the overall coating thickness and prevent cracking and sintering of the coatings.[20] This is further demonstrated in FIGS. 4A-4D. FIG. 4A shows an SEM image of the native cotton and the inherent striations of the cellulose fibers can be discerned. In FIG. 4B, the fiber is coated with $Al_2O_3$ from the f-$Al_{13}$ cluster solution and the striations can still be discerned, indicating a relatively thin and uniform $Al_2O_3$ coating. However, the fibers coated from the $Al(NO_3)_3$ precursor solution in FIG. 4C appear significantly rougher, which is likely due the increased number of nitrate counterions that have to burn off which leads to a rougher coating with more morphological defects. FIG. 4D shows the f-$Al_{13}$ coating after UV and thermal treatment.

Figure 5C:
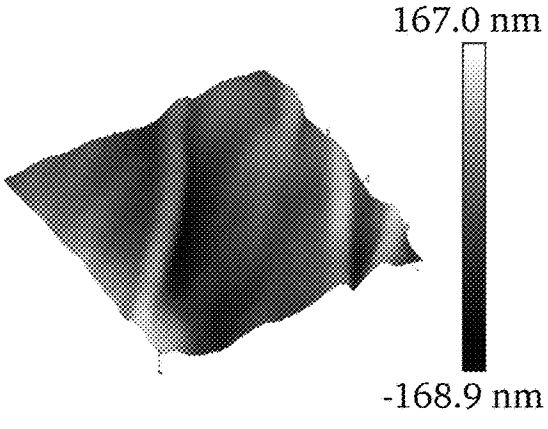
FIGS. 5A-5C are 2 μm$^2$ AFM scans of native cotton, sample $Al_{13}$-UV, and sample $Al(NO_3)_3$-UV.
Figure 5B:
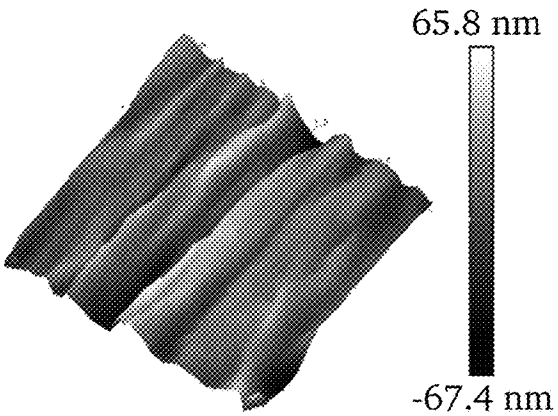
Figure 5A:
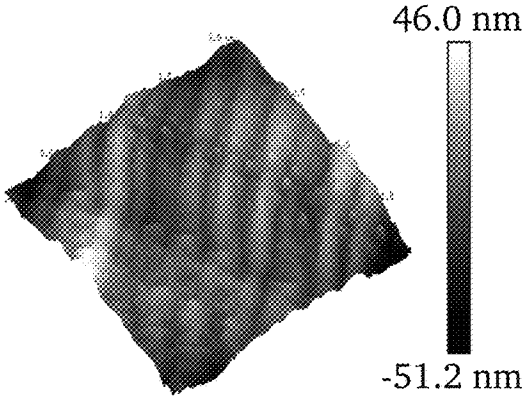

To further probe the morphology of these coatings, the surface roughness of the prepared samples was explored through atomic force microscopy (AFM). FIGS. 5A-5C show 2 $\mu m^2$ AFM scans of individual fibers on native cotton, sample $Al_{13}$-UV, and sample $Al(NO_3)_3$-UV, respectively. In all three cases, a textured surface can be elucidated and the resulting RMS roughness ($R_{rms}$) and average roughness ($R_A$) are presented in Table 2. Interestingly, coating the cotton in $Al_2O_3$ from the f-$Al_{13}$ only slightly increases the surface roughness of the cotton, whereas there is a drastic increase in the RMS roughness in the cotton coated from $Al(NO_3)_3$. This roughness discrepancy can be likely attributed to the increased nitrate to aluminum ratio in $Al(NO_3)_3$ (3:1 ratio) compared to that of the f-$Al_{13}$ (1.15:1). In order to form the final film, these nitrate groups need to decompose and therefore the additional nitrate groups present in the $Al(NO_3)_3$ coatings lead to a more porous and rougher coating.

TABLE 2

Surface roughness of native and $Al_2O_3$ coated cotton.

| Sample | $R_{RMS}$ (nm) | $R_A$ (nm) |
|---|---|---|
| Native Cotton | 12.4 | 9.43 |
| $Al_{13}$ - UV | 18.7 | 14.6 |
| $Al(NO_3)_3$ - UV | 42.5 | 29.5 |

Elemental Analysis of Prepared Samples

It is important to address that one of the major advantages of this synthesis is that the presented precursor solution contains no organic additives or ligands. As a result, the final coating is composed of pure $Al_2O_3$ plus any elemental nitrogen that has not fully decomposed from residual nitrate counterions. Table 3 shows the elemental analysis of native cotton and the 4 prepared $Al_2O_3$ coatings. There are a couple of important conclusions that can be elucidated from this data. First, it is clear that cotton coated with the f-$Al_{13}$ cluster contains substantially less nitrogen than that of the analogous $Al(NO_3)_3$ coatings. This is expected due to the precondensed nature of the cluster, coupled with a higher aluminum to nitrate ratio (13:15) that enables coatings to more readily condense.[12] Second, as expected, the addition of heat to this process also contributes to reduced nitrogen content in the coatings. Based on previous literature, it is not unreasonable to suspect that an optimized process with a higher powered lamp will remove all of the nitrate and further enhance the contact angle.

TABLE 3

Elemental analysis of native and $Al_2O_3$ coated cotton samples

| | Chemical composition (at. %) | | | | | |
|---|---|---|---|---|---|---|
| | C | | | | | |
| Sample | C—H | C—OH | C—O—C | Al | O | N |
| Native Cotton | 38.84 | 27.35 | 6.63 | — | 27.17 | — |
| $Al_{13}$ - UV | 36.41 | 22.1 | 5.55 | 3.51 | 30.02 | 2.41 |
| $Al(NO_3)_3$ - UV | 45.04 | 15.69 | 7.15 | 2.12 | 25.84 | 4.15 |
| $Al_{13}$ - UV/Thermal | 36.62 | 22.79 | 6.59 | 2.16 | 29.62 | 2.22 |

Scalability of Presented Hydrophobic Coatings

Figure 6:
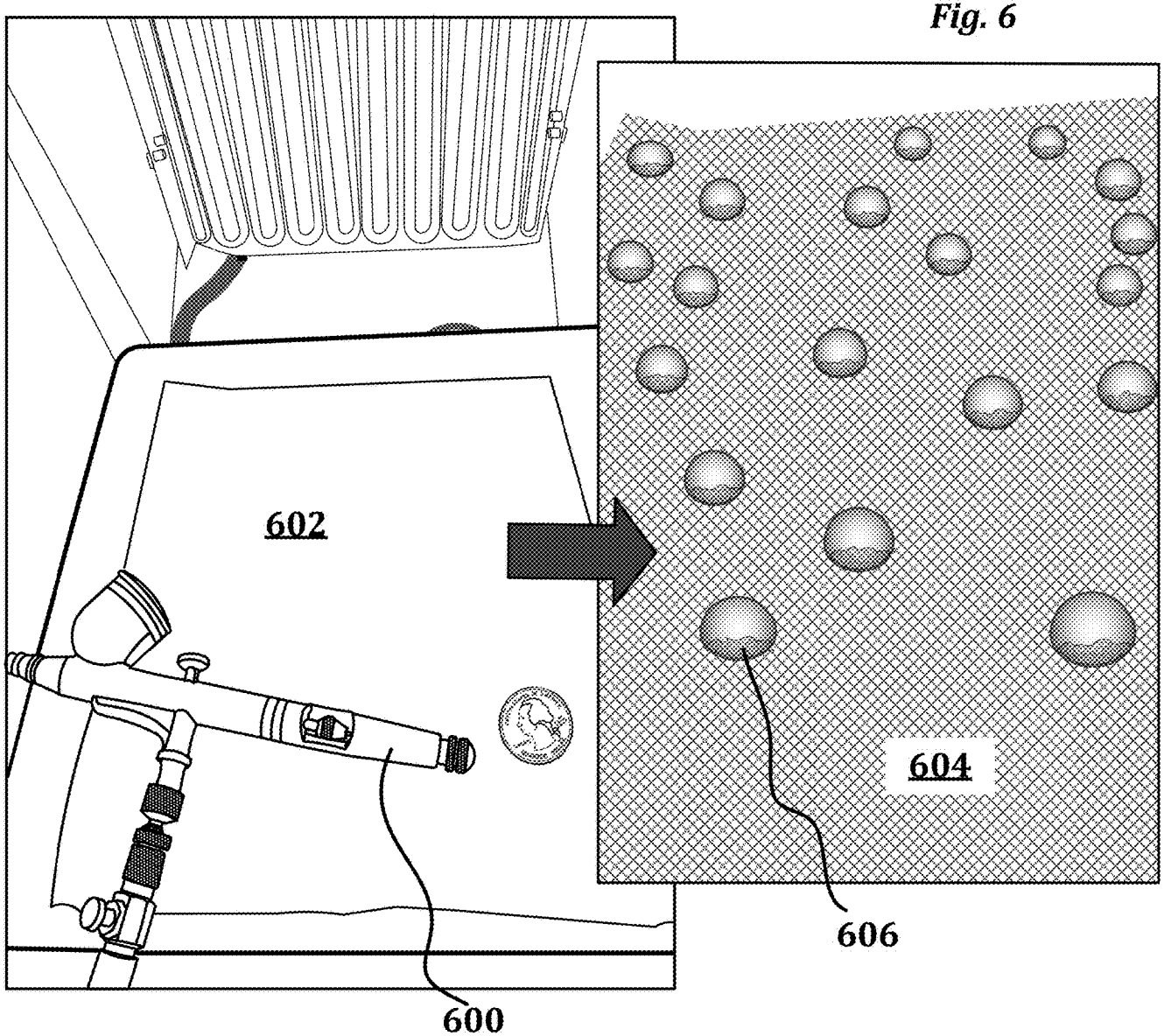
FIG. 6 is an image showing a spray coater used to coat 400 cm$^2$ of cotton to produce hydrophobic cotton.

Perhaps the greatest advantage of the presented process is the ability and ease of scaling up. The f-$Al_{13}$ precursor uses inexpensive starting materials, requires minimal synthetic steps, and can be fabricated in large quantities. The precursor solutions require minimal amounts of precursor (10 mM f-$Al_{13}$) dissolved in an acetone/water mixture that is environmentally benign. This solution can be deposited onto a variety of textiles via a multitude of scalable deposition techniques such as spray casting, dip coating, drip coating, spin coating, and ink jet printing. The UV photo-annealing step requires minimal energy, and scalability is only limited by the size/number of lamps used. As a representative example to showcase the scalability of the process, a 400 $cm^2$ piece of cotton fabric was spray-coated with the f-$Al_{13}$ precursor solution using an airbrush with $N_2$ flow. The sample was then subjected to 2 hours of ultraviolet light. The resulting hydrophobicity is presented in FIG. 6, which shows spray coater 600 used to coat 400 $cm^2$ of cotton 602 to produce hydrophobic cotton 604 with water drops 606 to illustrate hydrophobicity.

CONCLUSIONS

Herein is disclosed a scalable approach to forming $Al_2O_3$ coatings on textiles. Traditionally this has been accomplished with high energy techniques such as ALD or sol-gel processes that require multi-step processing and contain substantial organic additives. In this work, hydrophobic cotton can be achieved at ultra-low processing temperatures (30° C.) by utilizing deep ultraviolet light to photo-anneal the coatings. We demonstrate the viability of the f-$Al_{13}$ cluster, its advantages over $Al(NO_3)_3$, and the benefits of using solution deposition to produce hydrophobic $Al_2O_3$ coatings without the use of any organic additives or ligands.

Lastly, we display the scalability of this process by spray coating a 400 $cm^2$ piece of cotton with the f-$Al_{13}$ precursor solution, photo-annealing it for 2 hours at 30° C., and prove strong resulting hydrophobicity. These results show that this process can be easily scaled up and that photo-annealed $Al_2O_3$ hydrophobic coatings could be considered as a greener alternative to PFASs.

More generally, herein we have disclosed a method for producing a water-repellent textile by applying to a textile a solution of $Al_{13}$ nanoclusters or aluminum nitrate or its hydrates (e.g., $Al(NO_3)_3$ $9H_2O$ or hexahydrate) in a solvent to produce a wetted textile. The solvent may be a solubilizing organic solvent, pure water, or a miscible organic/water solvent mixture. For example, the solvent may be water, an acetone/water mixture, 2-methoxy ethanol, ethanol, a 2-methoxy ethanol/water mixture, or an ethanol/water mixture. Then, the wetted textile is photo-annealed with ultraviolet light having a wavelength in the range of 180 nm to 260 nm to produce an $Al_2O_3$ coating on fibers of the textile. Preferably, the light has a wavelength peak below 190 nm and/or a wavelength peak above 200 nm. The textile may be any of various common textiles including cotton, polyester, wool, nylon, chiffon, nubuck, leather, burlap, silk, denim, or any combination thereof.

In one implementation, the solution has an acetone/water ratio of 5:1. More generally, the acetone/water ratio preferably ranges from 1:1 to 10:1. The solution may be, for example, a 5 mM to 20 mM solution of $Al_{13}$ nanoclusters (i.e., flat-$Al_{13}$ nanoscale clusters, $Al_{13}(\mu_3\text{-OH})_6(\mu\text{-OH})_{18}(H_2O)_{24}(NO_3)_{15}$) in acetone/water, or a 0.05 M to 0.2 M solution of aluminum nitrate ($Al(NO_3)_3\ 9H_2O$) in acetone/water. Applying the solution to the textile may be performed using various techniques including spray coating, drip coating, drop coating, dip coating, spin coating, or ink jet printing.

The photo-annealing of the wetted textile with ultraviolet light may be performed, for example, with a mercury lamp having power in the range 25-28 mW/cm$^2$, or in some implementations a power in the range 5-8 mW/cm$^2$ may be used. The ultraviolet light preferably has wavelengths with peaks at or near 253.7 and 183.9 nm. The photo-annealing of the wetted textile with ultraviolet light preferably heats the wetted textile to a temperature no more than 150° C.

In some embodiments of the method, after photo-annealing, the method may include an additional step of thermally treating the textile at a temperature no more than 150° C., or more preferably, no more than 60° C.

REFERENCES

[1] Buck, R. C.; Murphy, P. M.; Pabon, M. Chemistry, properties and uses of commercial fluorinated surfactants, T. P. Knepper, F. T. Lange (Eds.), *The Handbook of Environmental Chemistry: Polyfluorinated Chemicals and Transformation Products*. 2012, Springer, London, 1-19

[2] Barry, V.; Winquist, A.; Steenland, K. Perfluorooctanoic Acid (PFOA) Exposures and Incident Cancers among Adults Living near a Chemical Plant. *Environ Health Perspect* 2013, 121 (11-12), 1313-1318.

[3] Buck R. C.; Schubert, K. V. Textile fluorochemicals—what users need to know *AATCC Rev.,* 2009, 9 (5), 32-36

[4] Farre, M.; Llorca, M.; Perez, S.; Barcelo D.; Perfluorinated compounds in food. T. P. Knepper, F. T. Lange (Eds.), *The Handbook of Environmental Chemistry: Polyfluorinated Chemicals and Transformation Products*. 2012, 127-14

[5] Shiwanov, E. Chain reactions: a deep look into the DWR dilemma and the current options for product designers. *Inside Outdoor Mag.* 2015, 24-29

[6] Barry, V.; Winquist, A.; Steenland, K. Perfluorooctanoic Acid (PFOA) Exposures and Incident Cancers among Adults Living near a Chemical Plant. *Environ. Health. Perspect.* 2013, 121 (11-12), 1313-1318

[7] Hill, P. J.; Taylor, M.; Goswami, P.; Blackburn, R. S. Substitution of PFAS Chemistry in Outdoor Apparel and the Impact on Repellency Performance. *Chemosphere* 2017, 181, 500-507.

[8] Stanley, J. K.; Coleman, J. G.; Weiss, C. A.; Steevens, J. A. Sediment Toxicity and Bioaccumulation of Nano and Micron-Sized Aluminum Oxide. *Environ. Toxicol. Chem.* 2010, 29 (2), 422-429.

[9] Lee, K.; Jur, J. S.; Kim, D. H.; Parsons, G. N. Mechanisms for Hydrophilic/Hydrophobic Wetting Transitions on Cellulose Cotton Fibers Coated Using Al2O3 Atomic Layer Deposition. *J. Vac. Sci. Technol. A* 2012, 30 (1), 01A163.

[10] Johnson, R. W.; Hultqvist, A.; Bent, S. F. A Brief Review of Atomic Layer Deposition: From Fundamentals to Applications. *Materials Today* 2014, 17 (5), 236-246.

[11] Damayanti, N. P. Preparation of Superhydrophobic PET Fabric from Al2O3—SiO2 Hybrid: Geometrical Approach to Create High Contact Angle Surface from Low Contact Angle Materials. *J. Sol-Gel Sci. Techn.* 2010, 1 (56), 47-52.

[12] Pan, C.; Shen, L.; Shang, S.; Xing, Y. Preparation of Superhydrophobic and UV Blocking Cotton Fabric via Sol-Gel Method and Self-Assembly. *Appl. Surf Sci.* 2012, 259, 110-117.

[13] Fulton, B. L.; Perkins, C. K.; Mansergh, R. H.; Jenkins, M. A.; Goulouk, V.; Jackson, M. N.; Ramos, J. C.; Rogovoy, N. M.; Gutierrez-Higgins, M. T.; Boettcher, S. W.; Conley, J. F.; Keszler, D. A.; Hutchison, J. E.; Johnson, D. W. Minerals to Materials: Bulk Synthesis of Aqueous Aluminum Clusters and Their Use as Precursors for Metal Oxide Thin Films. *Chem. Mater.* 2017, 29 (18), 7760-7765.

[14] Smith, S. W.; Wang, W.; Keszler, D. A.; Conley, J. F. Solution Based Prompt Inorganic Condensation and Atomic Layer Deposition of $Al_2O_3$ Films: A Side-by-Side Comparison. *J. Vac. Sci. Technol. A* 2014, 32 (4), 041501.

[15] Kim, Y.-H.; Heo, J.-S.; Kim, T.-H.; Park, S.; Yoon, M.-H.; Kim, J.; Oh, M. S.; Yi, G.-R.; Noh, Y.-Y.; Park, S. K. Flexible Metal-Oxide Devices Made by Room-Temperature Photochemical Activation of Sol-Gel Films. *Nature* 2012, 489 (7414), 128-132.

[16] Jo, J.-W.; Kim, Y.-H.; Park, J.; Heo, J. S.; Hwang, S.; Lee, W.-J.; Yoon, M.-H.; Kim, M.-G.; Park, S. K. Ultralow-Temperature Solution-Processed Aluminum Oxide Dielectrics via Local Structure Control of Nanoclusters. *ACS Appl. Mater. Inter.* 2017, 9 (40), 35114-35124.

[17] Wang, W.; Wentz, K. M.; Hayes, S. E.; Johnson, D. W.; Keszler, D. A. Synthesis of the Hydroxide Cluster $[Al_{13}(\mu_3\text{-OH})_6(\mu_2\text{-OH})_{18}(H_2O)_{24}]^{15+}$ from an Aqueous Solution. *Inorg. Chem.* 2011, 50 (11), 4683-4685.

[18] Park, S.; Kim, K.-H.; Jo, J.-W.; Sung, S.; Kim, K.-T.; Lee, W.-J.; Kim, J.; Kim, H. J.; Yi, G.-R.; Kim, Y.-H.; Yoon, M.-H.; Park, S. K. In-Depth Studies on Rapid Photochemical Activation of Various Sol-Gel Metal Oxide Films for Flexible Transparent Electronics. *Adv. Funct. Mater.* 2015, 25 (19), 2807-2815.

[19] Cochran, E. A.; Woods, K. N.; Johnson, D. W.; Page, C. J.; Boettcher, S. W. Unique Chemistries of Metal-Nitrate Precursors to Form Metal-Oxide Thin Films from Solution: Materials for Electronic and Energy Applications. *J. Mater. Chem. A* 2019, 7 (42), 24124-24149.

[20] Norelli, K. M.; Plassmeyer, P. N.; Woods, K. N.; Glassy, B. A.; Knutson, C. C.; Beekman, M.; Page, C. J. Influence of Composition and Processing Parameters on the Properties of Solution-Processed Aluminum Phosphate Oxide (AlPO) Thin Films. *Solid State Sciences* 2016, 55, 8-12.

The invention claimed is:

1. A method for producing a water-repellent textile, the method consisting of:

applying to a textile a solution of $Al_{13}$ nanoclusters in a solvent to produce a wetted textile; wherein the solution is a solution of $Al_{13}$ nanoclusters in acetone/water, where the $Al_{13}$ nanoclusters are flat-$Al_{13}$ nanoscale clusters, $Al_{13}(\mu_3\text{-OH})_6(\mu\text{-OH})_{18}(H_2O)_{24}(NO_3)_{15}$; and photo-annealing the wetted textile with ultraviolet light having a wavelength in the range of 180 nm to 260 nm at ambient temperature to produce an $Al_2O_3$ coating on fibers of the textile to produce the water-repellent textile.

2. The method of claim 1 wherein the textile comprises cotton, polyester, wool, nylon, chiffon, nubuck, leather, burlap, silk, denim, or any combination thereof.

3. The method of claim 1 wherein the solvent is acetone/water, and the solution has an acetone/water ratio ranging from 1:1 to 10:1.

4. The method of claim 1 wherein the solvent is acetone/water, and the solution has an acetone/water ratio of 5:1.

5. The method of claim 1 wherein the solution is a 5 mM to 20 mM solution of $Al_{13}$ nanoclusters in acetone/water.

6. The method of claim 1 wherein applying the solution to the textile comprises spray coating, drip coating, drop coating, dip coating, or ink jet printing.

7. The method of claim 1 wherein the ultraviolet light has wavelengths with at least one peak below 190 nm.

8. The method of claim 1 wherein the ultraviolet light has wavelengths with at least one peak above 200 nm.

9. The method of claim 1 wherein the ultraviolet light has wavelengths with peaks at 253.7 and 183.9 nm.

10. The method of claim 1 wherein photo-annealing the wetted textile with ultraviolet light is performed with a mercury lamp having power in the range 25-28 $mW/cm^2$.

11. The method of claim 1 wherein photo-annealing the wetted textile with ultraviolet light is performed with a mercury lamp having power in the range 5-8 $mW/cm^2$.

12. The method of claim 1, wherein the temperature is up to 30° C.

* * * * *